United States Patent [19]

Cooper et al.

[11] Patent Number: 4,719,727

[45] Date of Patent: Jan. 19, 1988

[54] ACCESS FLOOR PANEL

[75] Inventors: Gordon J. Cooper, Alto; Todd N. Rose, Kentwood, both of Mich.

[73] Assignee: C-Tec, Inc., Grand Rapids, Mich.

[21] Appl. No.: 784,859

[22] Filed: Oct. 4, 1985

[51] Int. Cl.[4] ..... E04B 5/00

[52] U.S. Cl. ..... 52/126.6; 52/126.1; 52/787

[58] Field of Search ..... 52/585, 126.1, 126.6, 52/126.7, 787

[56] References Cited

U.S. PATENT DOCUMENTS

| | | | |
|---|---|---|---|
| 1,845,711 | 2/1932 | Honig et al. . | |
| 2,154,036 | 4/1939 | Doherty . | |
| 2,585,557 | 2/1952 | Kreimendahl | 52/787 |
| 2,956,653 | 10/1960 | Liskey, Jr. | 52/126.6 |
| 3,759,009 | 9/1973 | Ransome . | |
| 4,296,586 | 10/1981 | Heurteux | 52/787 |
| 4,606,156 | 8/1986 | Sweers et al. | 52/126.6 |

FOREIGN PATENT DOCUMENTS

| | | | |
|---|---|---|---|
| 2900759 | 7/1980 | Fed. Rep. of Germany | 52/787 |
| 818195 | 9/1937 | France | 52/126.1 |
| 2532350 | 3/1984 | France | 52/126.1 |
| 601449 | 6/1960 | Italy . | |
| 70265 | 1/1952 | Netherlands | 52/673 |
| 452163 | 5/1968 | Switzerland | 52/126.6 |
| 1173665 | 12/1969 | United Kingdom | 52/126.6 |

OTHER PUBLICATIONS

Drawings from U.S. Application Ser. No. 519,468, filed Aug. 4, 1983.

Brochure entitled, "New Foundations for Office Design: Access Flooring by C-Tec".

*Primary Examiner*—William F. Pate, III

*Assistant Examiner*—Caroline D. Dennison

*Attorney, Agent, or Firm*—Price, Heneveld, Cooper, DeWitt & Litton

[57] ABSTRACT

An access floor panel includes a metal pan having a bottom and sidewalls. Lanced tabs extend from the bottom. A plurality of corner inserts include pad portions and core portions extending through the bottom. A concrete mixture encapsulates the tabs and insert core portions. The inserts cooperate with pedestal heads or plates to lock the panel to support pedestals. The panels also include silencer buttons. The buttons and inserts limit metal-to-metal contact. The inserts eliminate the need for stringers.

9 Claims, 6 Drawing Figures

ACCESS FLOOR PANEL

CROSS REFERENCE TO RELATED APPLICATION

This application discloses and claims subject matter disclosed in copending, commonly owned application Ser. No. 743,987, filed June 12, 1985.

BACKGROUND OF THE INVENTION

The present invention relates to flooring systems and more particularly to access floor panels.

In many installations, it is necessary or desirable to include an access floor system which is elevated above the structural floor of a building. The space between the structural floor and the access floor system contains power cables, communication cables, heating, cooling and ventilation equipment, communication equipment and the like. The raised floor system permits easy installation, renovation and interconnection of a wide variety of systems, such as computer equipment and the like.

A typical access floor system includes a plurality of floor panels supported on pedestals. A typical panel is approximately two feet square. The panel is supported at its corners on the pedestals which rest on the structural floor. Bridge channels or stringers are sometimes installed between the pedestals to provide lateral stability and increased strength.

Various forms of floor panels have heretofore been proposed. The panels may be of wood structure or of a high density composite core having galvanized steel sheets laminated to opposite floor surfaces. In this latter form, channels are sometimes welded to the perimeter of the steel sheets. These forms of panels have a high cost-to-strength ratio. Other forms of panels include a cement mixture core and metal cover sheets. These systems suffer from various problems, including difficulty of manufacture, high cost and insufficient strength or stability. Examples of prior systems may be found in U.S. Pat. No. 3,759,009, entitled COMPOSITE LOAD BEARING PANELS and issued on Sept. 18, 1973 to Ransome; U.S. Pat. No. 2,154,036, entitled CONSTRUCTIONAL FINISH DETAIL ELEMENT and issued on Apr. 11, 1939 to Doherty; and U.S. Pat. No. 1,845,711, entitled TILE AND FLOOR WITH SPECIAL METAL WEARING SURFACE and issued on Feb. 16, 1932 to Honig.

Commonly owned U.S. patent application Ser. No. 519,468, entitled ACCESS FLOORING PANEL, filed on Aug. 4, 1983 by Swers et al, now U.S. Pat. No. 4,606,156, discloses a unique panel which solves most of the aforementioned problems. The panel includes a lanced metal pan having tabs oriented generally radially inwardly toward a central portion of the pan. The pan is filled with a lightweight concrete mixture which encapsulates the tabs. The direction of the lances and the construction prevents ripping of the tabs under load. The metal pan provides tensile strength, and the concrete mixture provides compressive strength.

Commonly owned U.S. patent application Ser. No. 743,987, entitled APPARATUS AND METHOD FOR CASTING CONCRETE PANELS, filed June 12, 1985, in the names of Munsey et al, discloses an apparatus including a turntable which rotates about a vertical axis with a mold in a generally horizontal plane. A concrete mixture is poured into the mold and fills a metal pan or other reinforcing member positioned within the mold. The concrete mixture is rotationally cast. Provision is made for vibrating the mold during the casting operation. The rotation of the mold centrifugally casts the panel, resulting in a uniform distribution of the concrete mixture. Secondary manufacturing steps, such as grinding operations, are eliminated.

Heretofore, problems have been experienced obtaining the necessary stability and strength in access floor systems. As mentioned above, stringers or bridge channels have been needed. Such increases the cost and complexity of the system. Also, problems have been experienced with noise caused by contact between the panels and the support pedestals. A need exists for a panel and system which reduces system complexity while achieving the necessary strength and stability.

SUMMARY OF THE INVENTION

In accordance with the present invention, the aforementioned problems are substantially eliminated and the needs are met. Essentially, the present invention includes a floor panel having a pan and a concrete core. A plurality of corner pads or inserts are included which prevent direct pan-to-support contact. A pedestal having a head or plate includes a portion captured in or by the corner inserts thereby increasing stability and eliminating the need for stringers. Provision is made for fastening the panel to the pedestal with a screw. The pedestal head and inserts lock the panel to the pedestal.

The panel and system in accordance with the present invention reduce system complexity, result in greater ease of assembly and eliminate metal-to-metal contact to reduce noise in use.

DETAILED DESCRIPTION OF THE PREFERRED EMBODIMENT

Figure 1:
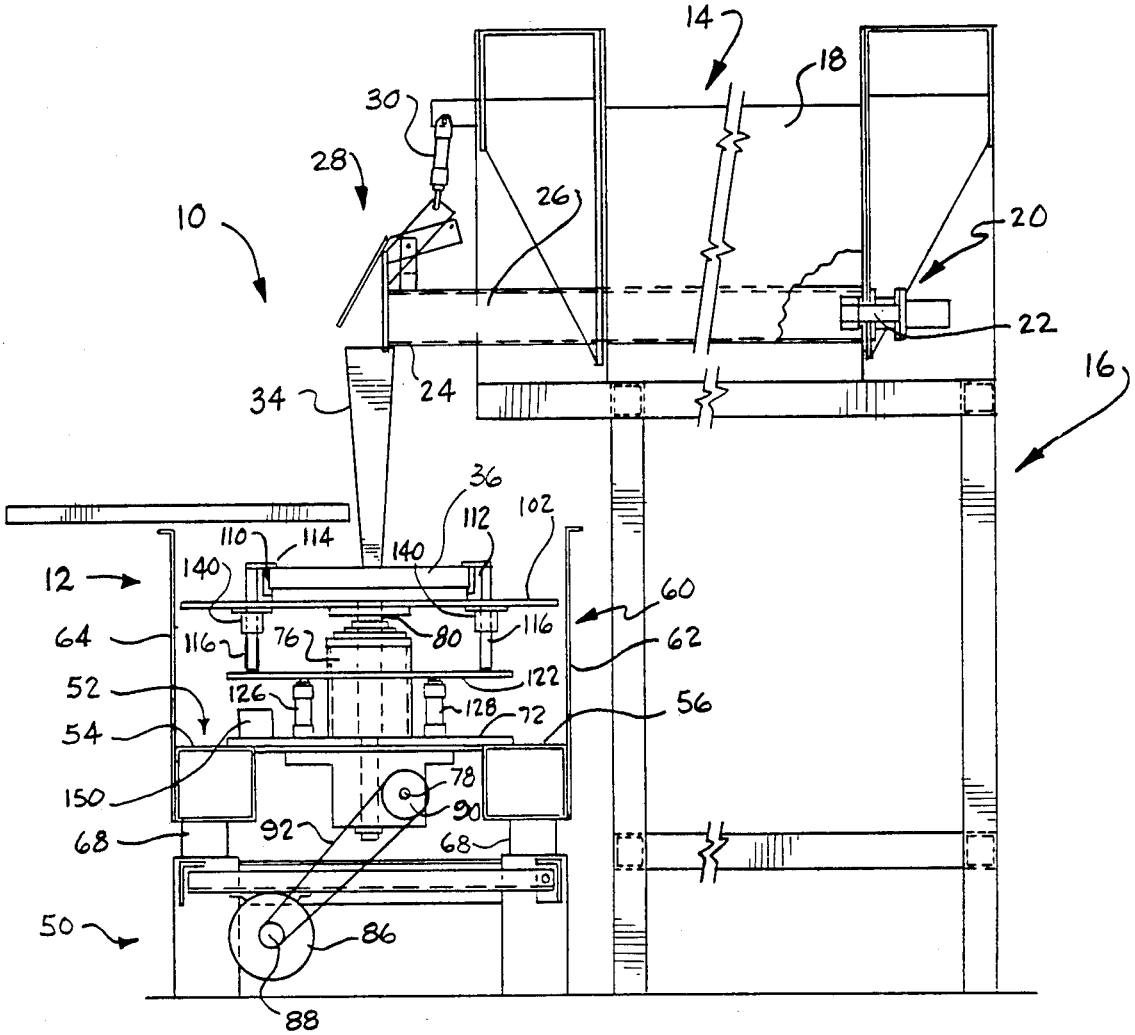
FIG. 1 is a schematic, side-elevational view of an apparatus for manufacturing access floor panels in accordance with the present invention.

An apparatus for manufacturing composite access floor panels in accordance with the present invention is illustrated in FIG. 1 and generally designated 10. A more detailed description of apparatus 10 may be found in aforementioned U.S. patent application Ser. No. 743,987. To the extent necessary, the disclosure of said application is hereby incorporated by reference.

Apparatus 10 includes a spinner or centrifugal casting apparatus generally designated 12 and a concrete mix or "mud" supply hopper 14. Hopper 14 is supported on a frame 16. Hopper 14 includes a bin 18 and a discharge or metering means 20. Bin 18 contains a concrete mixture. Discharge assistant 20 includes a shaft 22. Rotation of shaft 22 forces concrete mixture from bin 18 through the discharge opening or outlet 24 of a tube 26. A pivotal valve structure 28 is movable from a closed position to an open position, illustrated in phantom lines in FIG. 1, by a piston cylinder actuator 30. When valve 28 is open, a metered amount of concrete mixture is discharged from outlet 24 into a sprue 34. Sprue 34 directs the concrete mixture to a mold 36. Mold 36 is a thin cavity, generally rectangular mold. Mold 36 is supported in a horizontal plane by the centrifugal casting subassembly 12.

Centrifugal casting subassembly 12 includes a support frame or base structure 50 and an upper frame 52 including side members 54, 56. A housing 60 including walls 62, 64 is secured to upper frame 52. Upper frame 52 is supported on base frame 50 by a plurality of rubber blocks or vibration isolators 68. Extending between members 54, 56 of upper frame or support 52 is support or mounting plate 72. Secured to plate 72 is a drive housing 76. Housing 76 supports an input shaft 78 and a vertical output shaft 80. Shaft 78 is connected to shaft 80 by suitable gearing enclosed within the housing. Supported on base 50 is a variable speed drive motor 86. Drive motor 86 is operably connected to input shaft 78 by sprockets or pulleys 88, 90 and a flexible drive transmission means, such as a chain or belt 92.

A generally circular turntable 102 is nonrotatably secured to output shaft 80. Turntable 102 supports mold 36. A pair of opposed, elongated clamps including plates 110, 112 are supported on turntable 102. Each plate 110, 112 has a pair of spaced shafts or tubes 116 secured to the arms 114 and hence to the plates 110, 112, respectively. An actuator plate 122 encircles drive housing 76. Plate 122 is secured to piston cylinder actuators 126, 128. Tubes 116 extend downwardly through suitable apertures in turntable 102 and through housings 140.

A vibrator 150 is secured to support plate 72 (FIG. 1). Vibrator 150 is a conventional item which includes a hydraulic or other drive for rotating an eccentric. Vibrator 150 causes frame 52 to vibrate or oscillate on rubber blocks 68.

Figure 2:
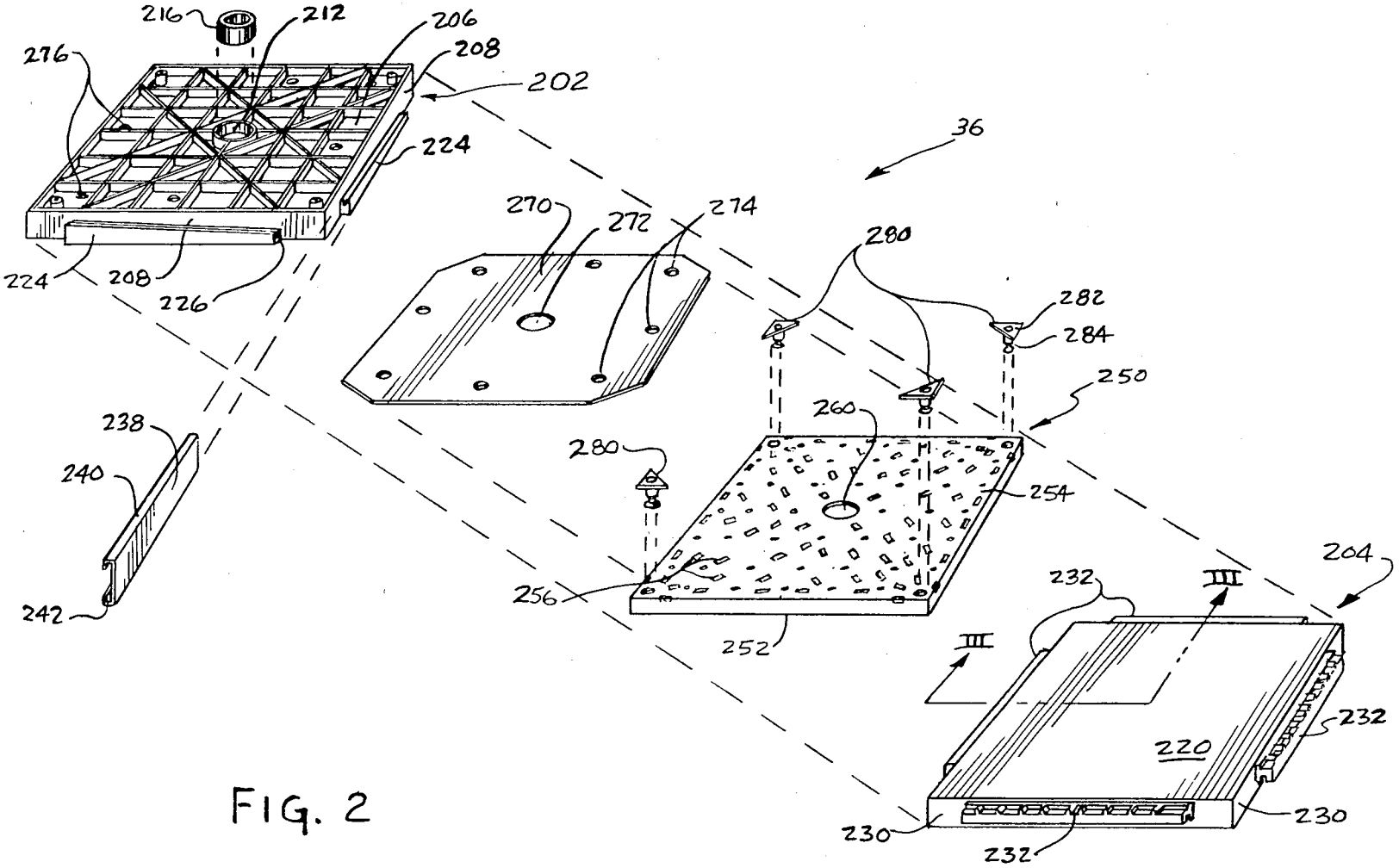
FIG. 2 is an exploded, perspective view showing a form of mold in accordance with the present invention.
Figure 3:
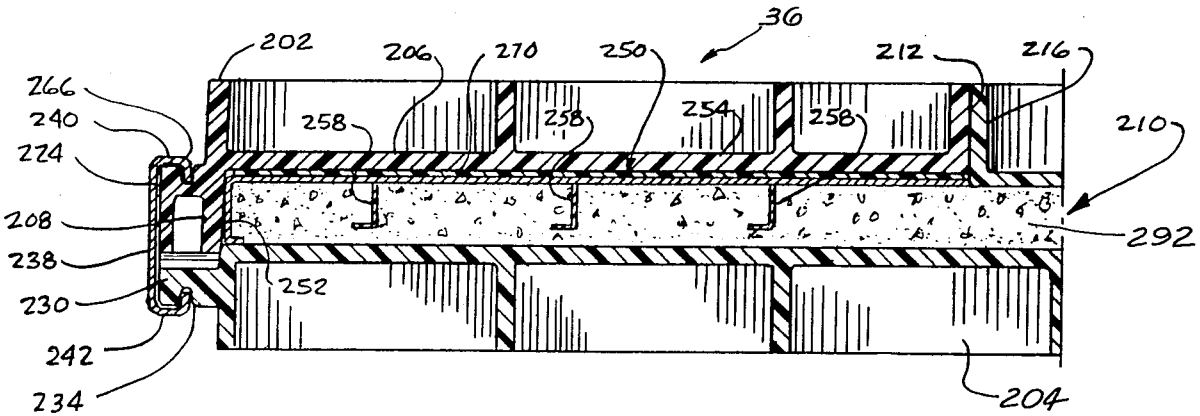
FIG. 3 is a cross-sectional view of the assembled mold taken generally along line III—III of FIG. 2.

A form of a thin cavity rectangular mold 36 is illustrated in FIGS. 2 and 3. Mold 36 includes a first mold half 202 and a second mold half 204. Mold half 202 includes a bottom 206 and peripheral sidewalls 208. Mold half 202 defines a generally rectangular cavity 210. Mold half 202 defines a centrally located filling aperture 212 which opens through bottom 206 and into cavity 210. Aperture 212 is closed by a cylindrical plug 216 after the mold is filled with a cement mixture.

Mold half 204 defines a planar, substantially flat upper surface 220. Mold halves 202, 204 must be fabricated from a sufficiently rigid material so that they do not flex during the casting operation. Flexing prior to curing of the concrete mixture may result in warping of the resulting floor panels. The molds may be precision fabricated from aluminum.

Extending along sidewalls 208 of upper mold half 202 are elongated, channel-shaped clamp members 224. Each member 224 defines an upwardly opening groove 226. Also, each member 224 is generally wedge-shaped in side elevation. Lower mold half 204 around its peripheral sides 230 includes a plurality of cooperating, elongated members 232. Each member 232 defines a downwardly opening groove 234. Mold halves 202, 204 are clamped together in a rigid fashion by a channel-shaped member 238. Member 238 includes inwardly facing and opposed flanges 240, 242. Member 238 is generally wedge-shaped in side elevation. Flanges 240, 242 are driven into and along grooves 226, 232, respectively.

The enclosed recess 210 defined by the clamped mold halves 202, 204 is precisely dimensioned to receive a stamped metal pan 250. The thickness of the mold recess or cavity 210 is on the order of one-half inch to two and one-half inches. Pan 250 includes peripheral sidewalls 252 and a bottom 254. Bottom 254 is lanced to define a plurality of apertures 256. The lancing operation creates a plurality of tabs 258. The tabs extend in quadrants generally radially outwardly from the central portion of bottom 254. Bottom 254 also defines a central aperture 260. Aperture 260 is coaxial with aperture 212 of mold half 202. Aperture 260 has a diameter which corresponds to the diameter of aperture 212.

A generally rectangular, flexible sheet 270 is sandwiched between the inner surface of bottom 206 of mold half 202 and the outer surface of bottom 254 of pan 250. Sheet 270 is a flexible, rubber-like material which has magnetic material embedded therein. The sheet, therefore, will adhere to bottom surface 254 of pan 250. As seen in FIG. 3, sheet 270 is disposed within recess 210 and against bottom 254. Sheet 270 also defines a central aperture 272 which is coaxially aligned with apertures 212 and 258. Sheet 270 defines a plurality of ejection apertures 274. Apertures 274 are aligned with ejection apertures 276 defined by bottom 206 of mold half 202.

In making up mold 36, sheet 270 is disposed within recess 210. A plurality of corner core pads or corner inserts 280 (FIGS. 4 and 5) are then disposed in each of the four corners of recess 210. Inserts 280 include a generally triangular pad portion 282 and a central core portion 284. Each core portion 284 extends through a corner or core aperture 286 defined by pan 250. Pan 250 with inserts 280 in place is then slip fit into recess 210. Mold half 204 is placed in position with respect to half 202. The two halves are then clamped together, as described above. The made up mold 36 is then positioned on turntable 102 of centrifugal casting subassembly 12. Sprue 34 is positioned at aperture 212 and the concrete mixture 292 is metered from hopper 14 and into the mold. Variable speed motor 86 is actuated and turntable 102 is rotated about its vertical axis defined by shaft 80. Shaft 80 is coaxial with apertures 212, 258 and 272 of mold half 202, pan 250 and sheet 270, respectively. As mold 36 is rotated, the cement mixture 292 is centrifugally spread or cast throughout recess 210 now defined by pan 250 and bottom mold half 204. In order to insure an inclusion-free core within the pan, vibrator 150 is actuated. The speed of rotation of turntable 102 is steadily increased during the filling operation. The pan cavity is completely filled and the concrete mix is compacted within the pan due to centrifugal force and vibration.

Once the filling and casting operation is complete, turntable 102 is braked. Mold 36 is then ejected from the centrifugal casting subassembly. Core plug 216 is placed in sprue aperture 212 of mold half 202. After the concrete mix cures within the mold, wedges 238 are removed from mold halves 202, 204. Ejection pins are used to push the composite access floor panel from recess 210 of mold half 202. Magnetic sheet 270 insures that bottom 254 of pan 250 is weep free. All of the concrete mix is retained within the pan. Subsequent material removal operations are not necessary. The method and apparatus results in significant labor savings, increased production and increased quality.

Figure 4:
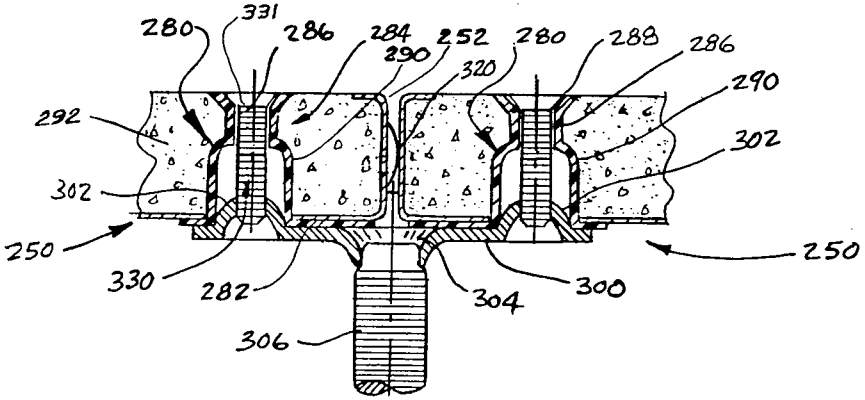
FIG. 4 is a fragmentary, cross-sectional view illustrating two adjacent access floor panels fabricated in accordance with the present invention disposed on a pedestal head.
Figure 5:
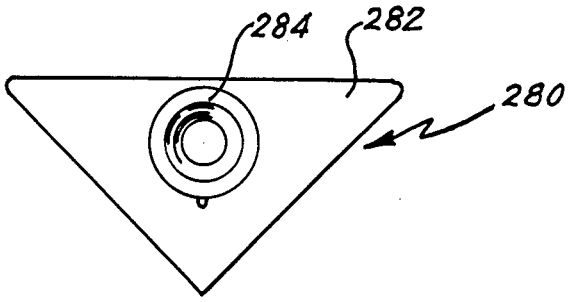
FIG. 5 is a top, plan view of a corner insert employed in the present invention.

As seen in FIG. 4, corner pads or inserts 280 are completely encapsulated by concrete mixture 292. Pad portions 282 are generally triangular and are configured to match the corners of pan 250 (FIG. 5). Core portion 284 defines a reduced diameter portion 286, a beveled portion 288 and an enlarged portion 290. The inserts are preferably fabricated from a statically conductive plastic material, such as polypropylene.

Figure 6:
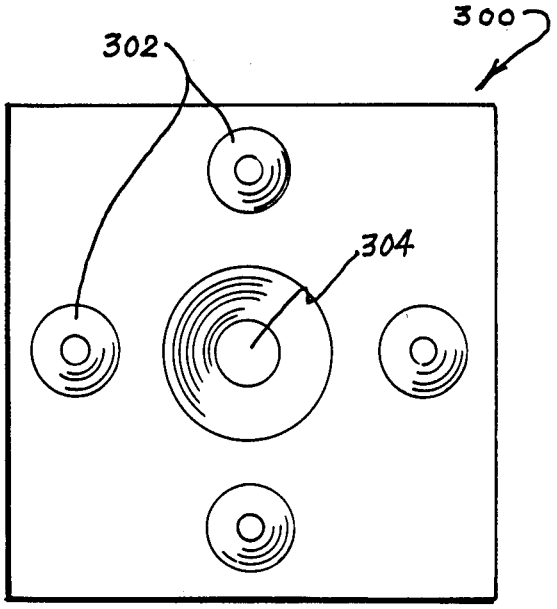
FIG. 6 is a top, plan view of a pedestal head or plate employed in the present invention.

Corner inserts 280 cooperate with a pedestal head or plate 300. As seen in FIGS. 4 and 6, pedestal plate 300 is square in plan. Plate 300 defines four equally spaced, semispherical portions 302. Portions 302 are dimensioned to be received within the enlarged bore portions 290 of corner inserts 280. Plate 300 also defines a central extruded aperture 304 at which the plate is welded to a pedestal 306. Each plate 300 supports adjacent corners of four access floor panels.

The pads or inserts 280 provide a plastic-to-metal contact at the support pedestals. This eliminates noise and rocking of the panels. In addition, spacer or silencer buttons 320 (FIG. 4) are inserted through sidewalls 252 of pan 250 at diagonally opposite points. Silencer buttons 320 are fabricated from a plastic or rubber material. As seen in FIG. 4, the buttons contact an adjacent panel. This also eliminates noise by preventing metal-to-metal contact. A fastener 330 cuts threads in reduced portion 286 of each corner insert. Fastener 330 is threaded into semispherical portion 302 of pedestal plate 300. Fastener 330 includes an unthreaded portion 331. When in the position shown in FIG. 4, the threads of fastener 330 do not engage the threads it has cut in portion 286 of insert 280. This retains the fastener when the panel is removed and reduces the chance of the fastener unintentionally backing out. The pedestal plates and cooperating corner pads incorporated in the present invention provide lateral stability at the tops of the pedestals. The pads and hence the panels are locked to the pedestal plates. This eliminates the need for stringers or elongated channel members extending between the pedestals. Such are no longer necessary for lateral stability.

In view of the foregoing description, those of ordinary skill in the art will undoubtedly envision various modifications to the present invention which would not depart from the inventive concepts disclosed herein. It is therefore expressly intended that the above description should be considered as only that of the preferred embodiment. The true spirit and scope of the present invention may be determined by reference to the appended claims.

The embodiments of the invention in which an exclusive property or privilege is claimed are defined as follows:

1. An access floor system, comprising:

a plurality of floor panels, each panel including a generally rectangular metal pan having a bottom and integral sidewalls, a plurality of corner inserts, each insert including a pad portion contacting an outer surface of said bottom and a core portion extending through said bottom, said core portion defining a bore opening through said pad portion and a concrete mixture within said pan and encapsulating said core portions of said inserts;

a plurality of supports, each support including a pedestal and a pedestal plate, said plate being joined to said pedestal and defining a plurality of semispherical portions, each semispherical portion being dimensioned to extend into one of said core portion bores; and a plurality of fasteners, each fastener interconnecting one of said inserts and said plates so that said panels are locked to said supports with said pad portions between said outer surface of said bottom and said supports, and wherein the core portion of each of said inserts defines a reduced diameter portion, said fasteners each engaging one of said reduced diameter portions and one of said semispherical portions of said plates.

2. An access floor system as defined by claim 1 wherein said pedestal plates each define four semispherical portions.

3. An access floor system as defined by claim 1 wherein said inserts are fabricated from a statically conductive plastic material.

4. An access floor system as defined by claim 3 wherein said statically conductive plastic material is polypropylene.

5. An access floor system as defined by claim 4 wherein said pedestal plates each define four semispherical portions.

6. An access floor system as defined by claim 1 further including silencer buttons extending from the sidewalls of said panels.

7. An access floor system as defined by claim 5 further including silencer buttons extending from the sidewalls of said panels.

8. An access floor system as defined by claim 1 wherein said fasteners each include a head, a nonthreaded portion and a threaded portion, said nonthreaded portion being within said reduced diameter portion of one of said insert core portions.

9. An access floor system as defined by claim 7 wherein said fasteners each include a head, a nonthreaded portion and a threaded portion, said nonthreaded portion being within said reduced diameter portion of one of said insert core portions.

* * * * *